United States Patent [19]

Rampolia et al.

[11] Patent Number: 4,914,793

[45] Date of Patent: Apr. 10, 1990

[54] QUICK-SEALING DESIGN FOR RADIOLOGICAL CONTAINMENT

[75] Inventors: Donald S. Rampolia, Pittsburgh; Elmer Speer, Ruffsdale, both of Pa.

[73] Assignee: The United States of America as represented by the United States Department of Energy, Washington, D.C.

[21] Appl. No.: 118,084

[22] Filed: Nov. 9, 1987

[51] Int. Cl.[4] ..... A44B 19/32

[52] U.S. Cl. ..... 24/389; 24/399; 24/304; 156/157; 156/218; 156/247; 312/1

[58] Field of Search ..... 24/389, 384, 304, DIG. 11, 24/399, 400; 383/52, 107, 108, 63, 64, 65; 156/66, 247, 157, 218; 34/15, 242

[56] References Cited

U.S. PATENT DOCUMENTS

| | | | |
|---|---|---|---|
| 2,602,208 | 7/1952 | Gossner | 24/389 X |
| 2,615,224 | 10/1952 | Shur . | |
| 2,753,609 | 7/1956 | Gossner . | |
| 3,176,364 | 4/1965 | Dritz | 24/304 |
| 3,389,442 | 6/1968 | Heimberger . | |
| 3,502,816 | 3/1970 | Heimberger . | |
| 3,627,600 | 12/1971 | Reiter | 156/66 |
| 3,668,745 | 6/1972 | Krupp . | |
| 3,685,103 | 8/1972 | Severino | 24/304 X |
| 4,239,829 | 12/1980 | Cohen | 24/DIG. 11 |
| 4,354,541 | 10/1982 | Tilman . | |

FOREIGN PATENT DOCUMENTS

| | | | |
|---|---|---|---|
| 2070132 | 9/1981 | United Kingdom | 24/304 |
| 2089424 | 6/1982 | United Kingdom | 24/389 |

*Primary Examiner*—James R. Brittain

*Attorney, Agent, or Firm*—William R. Moser; Judson R. Hightower; Richard E. Constant

[57] ABSTRACT

A quick-sealing assembly and method for forming an adhesive seal on opposite sides of a mechanical seal for a flexible containment bag of the type used for working with radioactively contaminated objects. The assembly includes an elongated mechanical fastener having opposing engaging members affixed at a predetermined distance from each of the elongated edges, with an adhesive layer formed between the mechanical fastener and the elongated edge such that upon engagement of the mechanical fastener and adhesive layers to opposing containment fabric, a neat triple hermetic seal is formed.

6 Claims, 4 Drawing Sheets

FIG. 5A
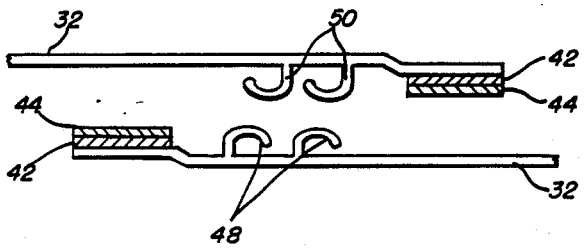
FIG. 5B
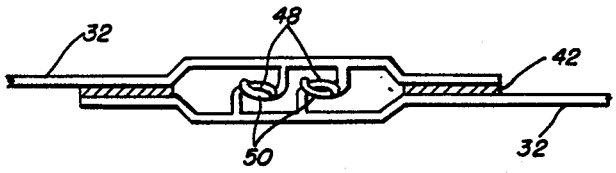
FIG. 6A
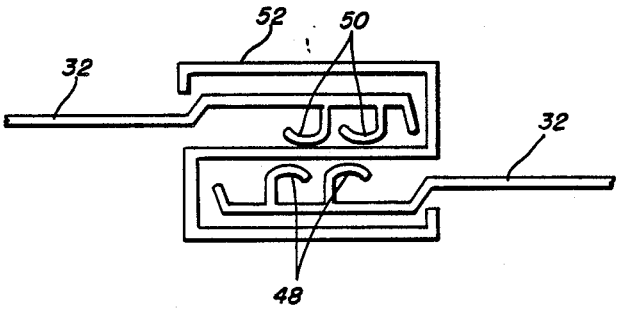
FIG. 6B
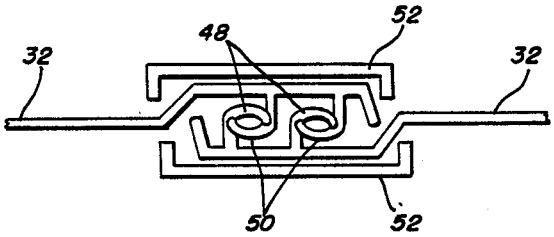
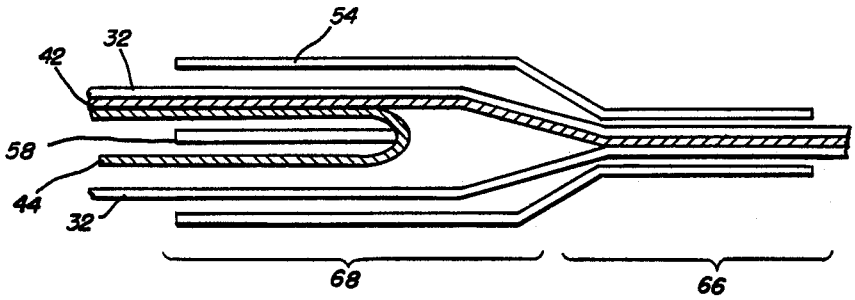
FIG. 8

QUICK-SEALING DESIGN FOR RADIOLOGICAL CONTAINMENT

BACKGROUND OF THE INVENTION

1. Field of the Invention

The present invention relates to a quick-sealing assembly and method which forms an adhesive seal on opposite sides of a mechanical seal for a flexible containment bag of the type used for working with radioactively contaminated objects.

2. Description of Related Art

Heretofore, the containment of radioactive material has required time-consuming procedures and operations in order to provide an adequate seal, even under the best of circumstances. For work in high radiation conditions, it is desirable to produce a quick and effective seal in order to reduce the amount of time personnel are exposed to radiation. In a typical containment application, such as that shown in FIG. 1, a section of pipe is to be cut out, and the pipe is to be plugged at both cut ends. The pipe may be internally contaminated with radioactive material in the form of a finely divided powder which may become airborne when the pipe is cut. Therefore, the containment apparatus in the past has included a slit bag with glove ports or the like, which is positioned to surround the work area. The slit edges are mechanically fastened together with a zipper, and the ends of the containment are taped and clamped to the pipe at either side of the section to be cut out. The zipper is known to provide a good mechanical joint, but is not considered to be an adequate seal against the release of the fine particulate radioactive material subsequent to cutting the pipe. This ineffectiveness of the zipper to contain the particulate material is partly due to the continuous flexing and movement of the containment device under normal working conditions. Therefore, in order to provide a more acceptable seal in the past, wide strips of cloth-backed adhesive tape were placed over both the inside and outside of the mechanical zipper.

Making a wrinkle-free adhesive seal by hand, as described, over a large area of flexible plastic material, is difficult even under normal working conditions. For some types of radiological work, the sealing process may be further complicated if the workers are required to wear anti-C gloves, if they work at awkward angles or in confined spaces, or if it is necessary to wear lead aprons or work from behind shielding. In some instances, making a satisfactory seal on the inside of the zipper can be even more complicated because part or all of the adhesive tape must be applied working through open glove ports. Then, when the inside taping is complete, gloves must be added to the ports which further increases the overall installation time.

Accordingly, a need in the art exists for the quick-sealing of a containment apparatus which is easy to install, is effective against the release of particulate radioactive material, and reduces the amount of time personnel are exposed to hazardous material.

SUMMARY OF THE INVENTION

Accordingly, it is a primary object of the present invention to provide a quick seal for radiological containment bags, which has a mechanical seal and two adhesive seals such that the mechanical seal is completely enclosed by two flaps of containment fabric which are adhesively sealed to the main body of the containment bag.

It is a further object of this invention to provide a quick seal for radiological containment, which may be used with varying types of mechanical seals.

The objects of the present invention are fulfilled by providing a sealing arrangement for joining two elongated edges of flexible sheet material to form a hermetic barrier, the arrangement comprising an elongated mechanical fastener having opposing engagable members affixed at a predetermined distance from each of the elongated edges, wherein a second elongated edge overlaps a first elongated edge upon engagement of the mechanical fastener thereby forming second and first flaps, respectively. An inner adhesive layer is formed on the first flap and an outer adhesive layer is formed on the second flap. A peel-off strip means is formed over each of the inner and outer adhesive layers prior to formation of the hermetic barrier, whereby the mechanical fastener and the first and second flaps combine to form said barrier.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those . skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 5A is a cross-sectional view of the sealing arrangement of FIG. 4 prior to adhesion of the two containment halves;

FIG. 5B is a cross-sectional view of the sealing arrangement of FIG. 4 subsequent to sealing the two containment halves together;

FIGS. 6A and 6B are cross-sectional views of a slide zipper entering the slide head and exiting the slide tail, respectively, for use with the sealing arrangement of FIG. 4;

FIG. 8 is a cross-sectional view of a peel-off strip removal of the slide zipper sealing arrangement in FIG. 7;

DETAILED DESCRIPTION OF PREFERRED EMBODIMENTS

Figure 1:
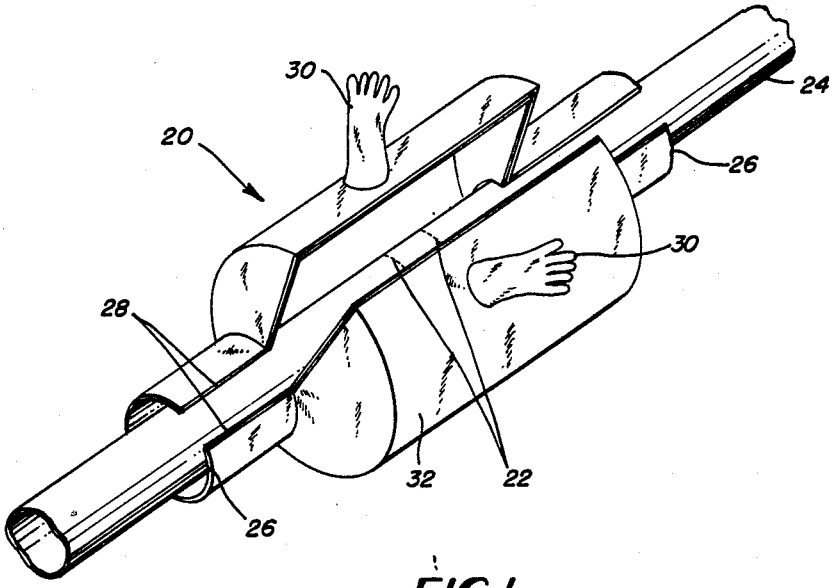
FIG. 1 is a perspective view of a conventional containment apparatus.

FIG. 1 is a perspective view of the conventional containment apparatus of the device used in the present invention which is generally shown at 20. In a typical containment apparatus, a section 22 of pipe 24 is to be cut out and the pipe is to be plugged at both cut ends. The pipe 24 is oftentimes internally contaminated with radioactive material in the form of a finely divided powder which may become airborne when the pipe is cut. Therefore, such cutting operations require the use of a containment device such as that shown at 20 which is a slit bag with glove ports 30 or the like which are placed over the work area. The slit edges 28 are normally fastened together mechanically with a zipper 28 and the ends 26 of the containment are taped and clamped to the pipe to either side of the section to be cut out. The zipper provides a good mechanical joint, but is normally not considered to be an adequate seal against the release of fine particulate radioactive material following the cutting operation. This is due in part to the many cycles of flexing which the zipper is subjected to in the containment apparatus under working conditions. An acceptable seal in the past has been provided by placing wide strips of cloth-backed tape (not shown) over both the inside and the outside of the zipper. In order to overcome the deficiencies noted with respect to this type of containment application, an improved sealing arrangement is provided by the present invention.

Provision of adhesive sealing surfaces with areas which can be made arbitrarily large while still retaining substantial flexibility of the sealed joint is achieved through the various embodiments of the present invention. This flexibility is achieved through placement of the sealing surfaces in the plane of the sheet material which forms the containment. Achieving maximum flexibility is especially important for radiological containments. Although for simplicity, the figures of the present invention are shown as utilizing an isolated run of straight piping to illustrate the installation of a radiological containment, practical applications most often involve some or all of the following complications:

(a) irregularly shaped objects, such as pipe or duct with bends and/or valves and/or air or water handling pumps; and (b) confined or relatively inaccessible spaces due, for example, to pipe or duct being adjacent to walls, or to other pipes or ducts, or to large immovable machinery.

Any of these complications leads to the requirement that the radiological containment have considerable flexibility. Additionally, during work performed on the contained object or objects, great flexibility of the containment material is usually required to permit workers to orient and manipulate tools, such as wrenches, saws, and pipe caps within the containment.

Figure 2A:
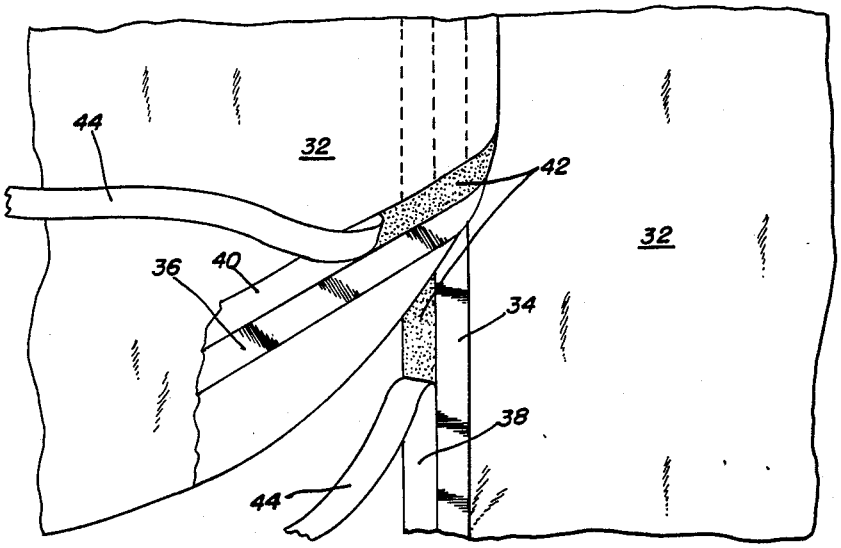
FIG. 2A is a top plan view of interlocking channels in a hook and pile fastener device of the present invention.

FIG. 2A is a top plan view according to a preferred embodiment of the present invention which forms a triple-seal by use of a hook and pile fastener device in the present invention. The containment fabric is shown at 32. At each slit edge of the containment fabric 32, there is an adhesive coated inner flap 38 and outer flap 40 formed between the slit edge and the mechanical fastener. The pressure-sensitive adhesive 42 is covered with peel-off strips 44 during operations prior to sealing. The mechanical sealing arrangement consists of a hook 34 and pile 36 type mechanical sealer. To make the seal, a short length of about 4 to 6 inches of the mechanical seal 34 and 36 is closed, then a short length also of about 4 to 6 inches of the peel-off strips 44 are peeled away and the adhesive seals made by pressing together the inner and outer layers of the containment fabric 32. Thus, the sequence is repeated until the mechanical and adhesive sealing are completed.

Figure 2B:
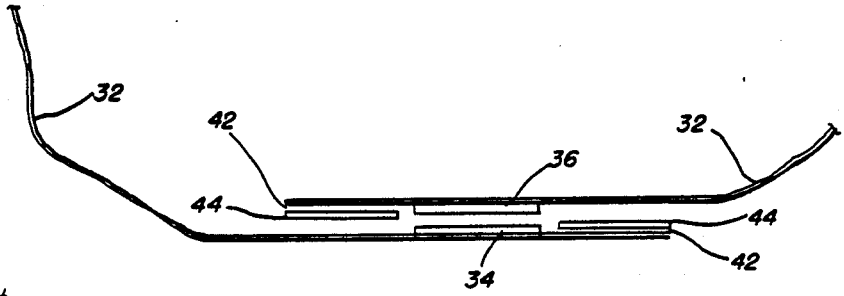
FIG. 2B is a cross-sectional view of the hook and pile fastener arrangement of FIG. 2A prior to adhesion of two containment halves.

FIG. 2B is a cross-sectional view of the hook and pile fastener arrangement of FIG. 2A prior to adhesion of the two containment halves. The containment halves are shown in an overlapping relationship such that the hook 34 and pile 36 are superimposed on top of each other, and the adhesive layers 42 with the peel-off strips 44 are each facing containment fabric. This arrangement permits sealing to be done rapidly compared with the usual method wherein many short pieces of tape are applied. Further, since the adhesive seal can be made by working through the unsealed part of the slit edge, or from the outside of the containment 20, the glove ports 30 can be present on the containment fabric 32 prior to installation. When workers are required to wear anti-C gloves during installation, a further advantage is achieved in that there is no need for contact between the workers gloves and the adhesive, thereby reducing the risk of tearing gloves and having skin contamination.

Figure 3:
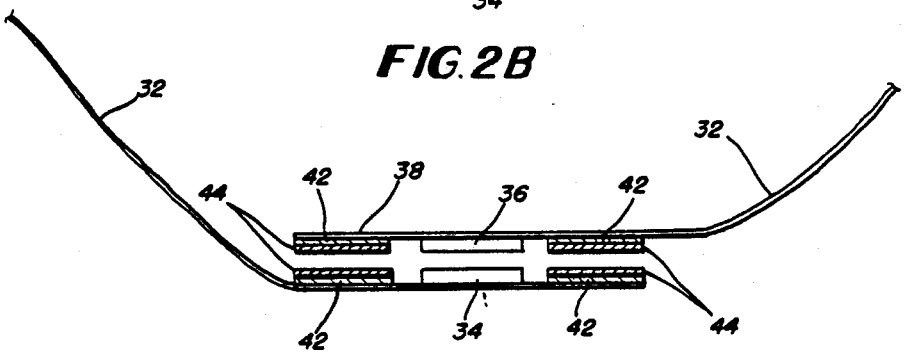
FIG. 3 is cross-sectional view of the sealing arrange of the present invention having additional adhesive portions.

FIG. 3 is a cross-sectional view of the sealing arrangement of the present invention wherein additional adhesive portions including an adhesive layer 42 and a peel-off strip 44 are formed in an opposing relationship on the containment fabric 32 in relation to the inner adhesive flap 38 and the outer adhesive flap 40, respectively. A similar mechanical hook 34 and pile 36 sealing arrangement may be utilized.

Figure 4:
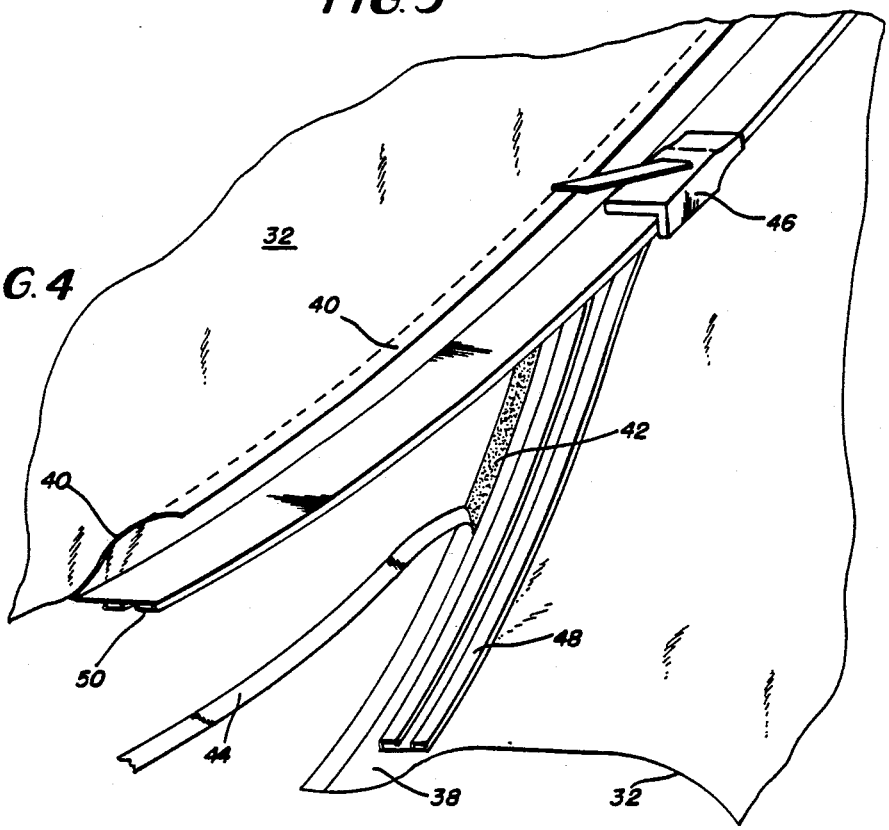
FIG. 4 is a perspective view of a press-together zipper used with adhesives in the sealing arrangement of the present invention.

FIG. 4 is a perspective view of a pressed together-type zipper used with the adhesive sealing arrangement in the present invention. The pressed together mechanical seal includes a lower interlocking channel 48 and an upper interlocking channel 50 which are pressed together by a slide 46 to form the mechanical seal. Similar to the arrangements of FIGS. 2 and 3, the inner adhesive flap 38 contains an adhesive layer 42 and a peel-off strip 44 as does the outer adhesive flap 40. In performing the sealing operation, the slide 46 can be moved along while peel-off strips are removed and the adhesive is pressed down on the containment fabric 32 to form the hermetic seal around the mechanical pressed together zipper arrangement.

FIG. 5A is a cross-sectional view of the sealing arrangement of FIG. 4 prior to adhesion of the two containment halves and FIG. 5B is a cross-sectional view of the sealing arrangement of FIG. 4 subsequent to sealing the two containment halves together. As such, the containment fabric 32 includes the lower interlocking channels 48 and the upper interlocking channels 50 near the elongated edge of a piece of containment fabric. These channels extend the length of the elongated edge of the containment fabric and are bordered at the outermost elongated edge of the containment fabric by adhesive layer 42 and peel-off strip 44. Subsequent to sealing, a neat triple seal is achieved as shown in FIG. 5B.

FIGS. 6A and 6B are cross-sectional views of a slide zipper entering a slide head and exiting the slide tail, respectively, for use with the sealing arrangement of FIG. 4. The slide head 52 encompasses the upper grooved channels 50 and the lower grooved channels 48 such that subsequent to sealing these channels are interlocked as shown in FIG. 6B. The remaining application of adhesive and peel-off strips is analogous to that shown in FIGS. 5A and 5B.

Figure 7:
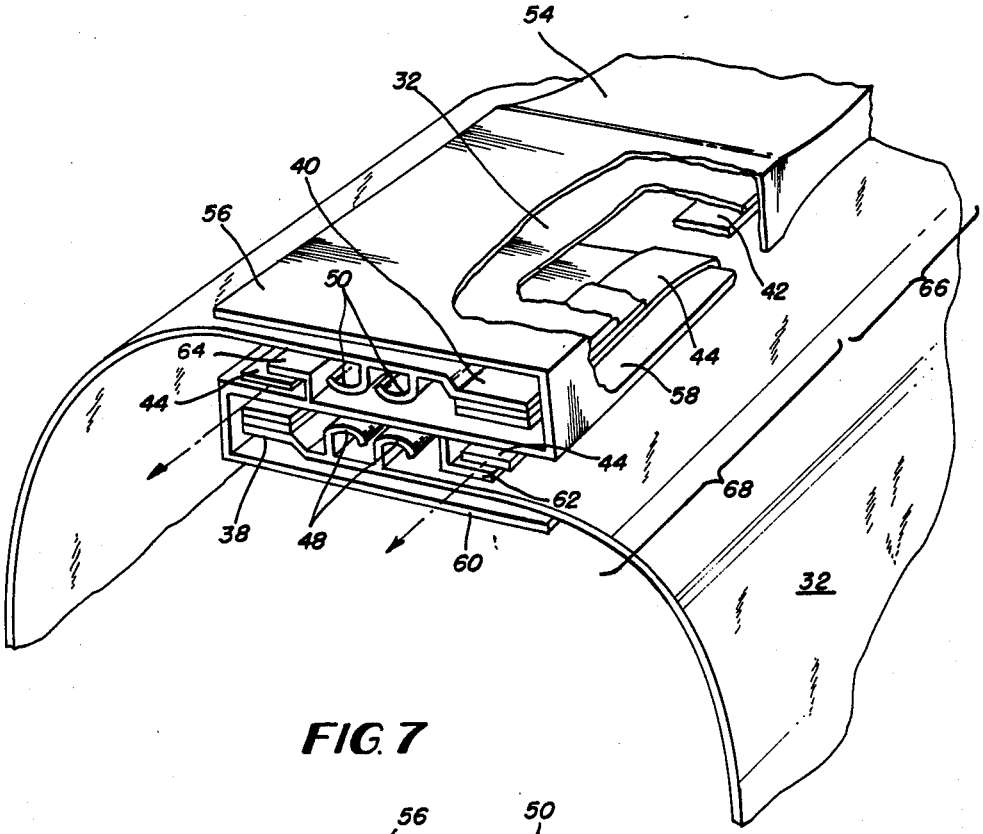
FIG. 7 is a perspective partially broken away view of another preferred embodiment of a slide zipper sealing arrangement of the present invention.

FIG. 7 is a perspective, partially broken away view of another preferred embodiment of the slide zipper sealing arrangement of the present invention. Slide head 54 includes an upper plate 56, a center plate 58 and a lower plate 60 in an inverted block "S" configuration. The center plate 58 runs approximately half the length of the slide, and together with the upper plate 56 and lower plate 60, forms the head 68 of the slide. The upper plate 56 and the bottom plate 60 neck down to form the tail 66 of the slide. The two halves of the zipper 48 and 50 feed into the head 68 and are compressed together and sealed as they pass through the tail 66. Slide head 54 is wider and longer than that of the zipper slide head shown at 52 in FIGS. 6A and 6B. The added width is required to accommodate the inner and outer adhesive flaps 38 and 40, respectively. The added length is in the tail section 66, and is required because of a thicker center plate 58.

The center plate is thicker and has a rounded back edge. The added thickness provides an adequate radius on the back edge thereof to permit the peel-off strip 44 to slide smoothly around the back edge. The center plate has separator slots 62 and 64 to keep the peel-off strip, after it passes over the back edge of the center plate 58, from riding over the interlocking channels 48 and 50 and causing the slide to bind.

The peel-off strip 44 from the outer flap 40 exits from the slide head on the outside of the containment. The peel-off strip 44 from the inner flap 38 exits from the slide head on the inside of the containment. However, since the containment seam is still open below the slide head, this peel-off strip 44 can be pulled through the open part of the seam. An important feature of this zipper design is that the slide does not contact the adhesive, and therefore there is no risk of adhesive accumulating on the slide and interfering with its smooth operation. Additionally, the center plate thickness is dictated by the radius required to permit the peel-off strips to slide smoothly over the back edge of the center plate. The required radius will depend on the coefficient of friction between the peel-off strip and the center plate and on the stiffness of the peel-off strip. The ideal peel-off strip is flexible, slippery on the exposed surface, and has good resistance to tearing. The center plate may be covered with slippery material such as nylon or teflon. An insert can also be clipped onto the center plate and serve two functions: first it would provide a slippery surface, and second, it would contain the separator slot. Use of such an insert simplifies fabrication of the slide since a plastic insert is easily moldable and installed on the slide center plate prior to final formation thereof.

FIG. 8 is a cross-sectional view of the peel-off strip removal of the slide zipper sealing arrangement in FIG. 7. The peel-off strip 44 is shown as being looped around the back edge of center plate 58 and pulled forward along with the slide head 54 to form the adhesive seal between the containment fabric 32 and the adhesive 42 near the tail end 66 of the slide.

Figure 9A:
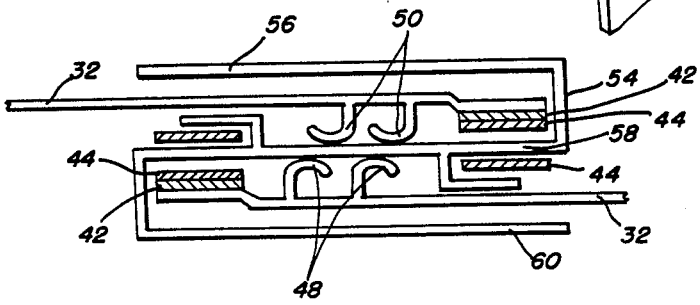
FIG. 9A is a cross-sectional view of the slide zipper sealing arrangement in FIG. 7 entering the slide head.
Figure 9B:
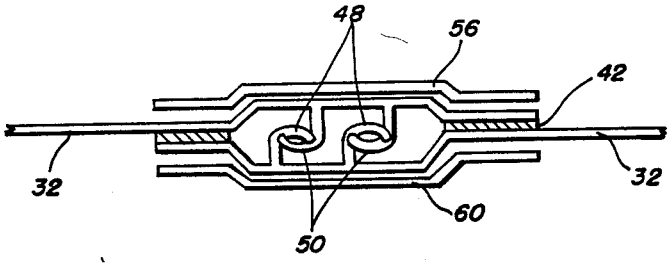
FIG. 9B is a cross-sectional view of the slide zipper sealing ,arrangement in FIG. 7 exiting the slide tail.

FIG. 9A is a cross-sectional view of the slide zipper sealing arrangement in FIG. 7 entering the slide head and FIG. 9B is a cross-sectional view of the slide zipper sealing arrangement in FIG. 7 exiting the slide tail. As described, the peel-off strips 44 are pulled forward and away from the adhesive material 42 until pressure from the tail end of the slide forms the adhesive bond between the adhesive 42 and the containment fabric 32. As such, the upper and lower groove channels 48 and 50 are interlocked to form a mechanical seal.

Figure 10:
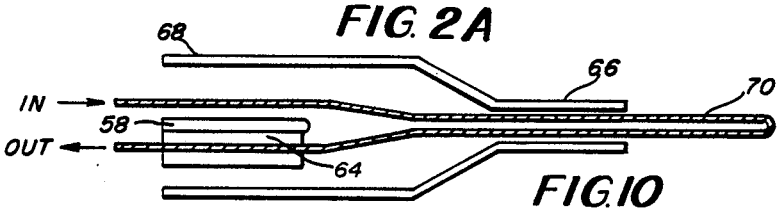
FIG. 10 is a cross-sectional view of a leader for a peel-off strip in the slide zipper sealing arrangement in FIG. 7.

FIG. 10 is a cross-sectional view of a leader 70 for a peel-off strip in the slide zipper sealing arrangement of FIG. 7. These leaders 70 are fed into the slide head, exiting through the slide tail. The leaders are then doubled back on themselves and fed into the slide tail through the separator slot, thereby exiting through the slide head.

According to the present invention, the adhesive sealing surfaces are protected from dirt and grease until the actual instant of forming the seals, by removal of the protective covering being accomplished simultaneously with the movement of the zipper slide. This feature is especially important in radiological work, since objects such as sections of air-handling duct, sections of liquid-carrying pipe, and pumps associated with either of the foregoing, any of which may have internal deposits of radioactive material to be enclosed in containments, as well as the environment surrounding such objects usually have surfaces which are covered with dust and/or oil. If the sealing adhesive is not otherwise protected from potential contact with degrading materials such as the dust and oil, then thorough cleaning of the surfaces is required to remove these materials and preclude inadvertent contact of the sealing adhesive therewith. However, the thorough cleaning of these surfaces, which are often in high radiation areas, would lead to undesirable radiation exposure to workers.

The present invention is therefore an arrangement whereby there is no contact whatsoever between the sealing surface and any component part of the zipper slide which could transfer dirt or grease from part of the zipper slide to the adhesive and thereby impair the quality of the adhesive seal.

Additionally, the positive adhesive seal through the action of the zipper slide is advantageous due to the potentially irregular shape of containment material at the sealing surfaces. This feature is especially important for the often occurring circumstance in radiological work where all or part of the seam to be sealed is in a relatively inaccessible location, thereby precluding access for hands or normal tools.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A sealing assembly for joining two elongated edges of flexible sheet material to form a hermetic barrier comprising:

an elongated mechanical slide fastener having opposing engaging members affixed at a predetermined distance from each of said elongated edges, the respective elongated edges overlapping upon engagement of said slide fastener thereby forming first and second flaps;

a first adhesive layer formed on said first flap;

a second adhesive layer formed on said second flap; and peel-off strip means formed over each of said first and second adhesive layers prior to formation of said barrier;

whereby said slide fastener and said first and second flaps combine to form said hermetic barrier, and wherein said slide fastener includes a slide and interlocking channel means for forming a mechanical seal as said slide passes over said interlocking channel means, said slide including:

a bottom plate, a center plate, and a top plate in an inverted block "S" configuration, a head end formed by said bottom, center, and top plates, a tail end formed by said bottom and top plates, wherein the overall height of said slide tapers from head to tail, said center plate having a rounded back edge adjacent said tail end and separator slots formed on opposing diagonal surfaces of said center plate and parallel to said interlocking channel means, said separator slots being formed for feeding said peel off strip means away from said first and second adhesive layers near the tail end of said slide and preventing said peel-off strip means from interfering with said interlocking channel means.

2. A sealing assembly according to claim 1, wherein said mechanical slide fastener includes opposing press-together channels.

3. A sealing assembly for joining two elongated edges of flexible sheet material to form a hermetic barrier comprising:

an elongated mechanical fastener having opposing engaging members affixed at a predetermined distance from each of said elongated edges, the respective elongated edges overlapping upon engagement of said mechanical fastener thereby forming first and second flaps, respectively;

a first adhesive layer formed on said first flap;

a second adhesive layer formed on said second flap;

peel-off strip means formed over each of said first and second adhesive layers prior to formation of said barrier;

means for operatively engaging said peel-off strip means with a portion of said elongated mechanical fastener to thereby form said hermetic seal;

wherein said mechanical fastener is a slide zipper including a slide and interlocking channel means, said slide including:

a bottom plate, a center plate, and a top plate in an inverted block "S" configuration, a head end formed by said bottom, center, and top plates, a tail end formed by said bottom and top plates, wherein the overall height of said slide tapers from head to tail, said center plate having a rounded back edge formed between said tail end and said head end and separator slots formed on opposing diagonal of said center plate surfaces and parallel to said interlocking channel means, said separator slots being said means for operatively engaging said peel-off strip means, whereby said peel-off strip means is fed around the rounded back edge of said center plate and drawn up to the head end of said slide to pull the slide forward while simultaneously engaging said mechanical fastener and said first and second flaps to opposing flexible sheet material.

4. A sealing assembly for joining the elongated edge portions of first and second sheets of material, each sheet having top and bottom sheet surfaces, comprising:

a first elongated mechanical slide fastener element attached to the top surface of the first sheet adjacent to the elongated edge portion of the first sheet;

a second elongated mechanical slide fastener element attached to the bottom surface of the second sheet adjacent to the elongated edge portion of the second sheet, wherein said first and second slide fastener elements are configured to interlock with each other when pressed together;

an adhesive layer formed on the top surface of the first sheet generally adjacent to said first slide fastener element;

peel-off strip means formed over said adhesive layer wherein said peel-off strip means is removable from said adhesive layer for thereby adhering said adhesive layer to the bottom surface of the second sheet; and a slide zipper means connectable to said first and second slide fastener elements and being configured to engage said first and second slide fastener elements and said peel-off strip means so that when said slide zipper means is connected to said first and second slide fastener elements and peel-off strip means and pulled generally along the direction of the elongated edge portions of the first and second sheets, said first and second slide fastener elements are pressed together and said peel-off strip means is removed from said adhesive layer by said slide zipper means.

5. The sealing assembly according to claim 4, wherein said slide zipper means includes a bottom plate, a center plate, and a top plate which are joined together so that said slide zipper means has a generally S-shaped cross-section and said center plate including slot means for directing said peel-off strip means away from said adhesive layer.

6. A sealing assembly for joining the elongated edge portions of first and second sheets of flexible material, comprising:

a first slide fastener element secured to the elongated edge portion of the first sheet;

a second slide fastener element secured to the elongated edge portion of the second sheet;

an adhesive layer formed on t least one of the first and second sheets adjacent respective to said first and second slide fastener elements;

peel-off strip means formed each of said adhesive layers; and slide zipper means connectable to said first and second slide fasteners for pressing said first and second slide fasteners together to form a mechanical seal therebetween and for removing said peel-off strip means from each said adhesive layer, said slide zipper means including a bottom plate, a center plate, and a top plate which are joined together so that said slide zipper means has a generally S-shaped cross-section and said center plate including slot means for directing said peel-off strip means away from each adhesive layer.

* * * * *

UNITED STATES PATENT AND TRADEMARK OFFICE

CERTIFICATE OF CORRECTION

PATENT NO. : 4,914,793

DATED : April 10, 1990

INVENTOR(S) : Rampolla et al

It is certified that error appears in the above-identified patent and that said Letters Patent is hereby corrected as shown below:

On the title page, in items [19] and [75], the first inventor's last name should be corrected to read as: --Rampolla--.

Signed and Sealed this

Seventeenth Day of November, 1992

*Attest:*

DOUGLAS B. COMER

*Attesting Officer*

*Acting Commissioner of Patents and Trademarks*